US007586937B2

(12) United States Patent
Tashiro

(10) Patent No.: US 7,586,937 B2
(45) Date of Patent: Sep. 8, 2009

(54) RECEIVING DEVICE AND METHOD

(75) Inventor: Atsushi Tashiro, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 615 days.

(21) Appl. No.: 10/577,440

(22) PCT Filed: Oct. 27, 2004

(86) PCT No.: PCT/JP2004/015892

§ 371 (c)(1),
(2), (4) Date: Apr. 27, 2006

(87) PCT Pub. No.: WO2005/057818

PCT Pub. Date: Jun. 23, 2005

(65) Prior Publication Data

US 2007/0073545 A1 Mar. 29, 2007

(30) Foreign Application Priority Data

Nov. 6, 2003 (JP) ..... 2003-377339

(51) Int. Cl.
*G10L 21/00* (2006.01)

(52) U.S. Cl. ..... 370/464; 704/500

(58) Field of Classification Search ..... 370/252, 370/389, 392, 352, 468, 464, 465; 704/500, 704/265; 375/316
See application file for complete search history.

(56) References Cited

U.S. PATENT DOCUMENTS 7,206,290 B2 * 4/2007 Qi et al. ..... 370/252
7,352,720 B2 * 4/2008 Chang et al. ..... 370/333
2002/0080728 A1 * 6/2002 Sugar et al. ..... 370/252
2003/0128670 A1 * 7/2003 Pinier et al. ..... 370/252

FOREIGN PATENT DOCUMENTS

JP 8-88607 A 4/1996
JP 8-125990 A 5/1996

OTHER PUBLICATIONS

Technical Paper of the Telecommunication Standardization Sector of ITU ITU-T Recommendation G.711 Appendix-I.
Technical Paper of the Telecommunication Standardization Sector of ITU ITU-T Recommendation G.711.
Technical Paper of the Telecommunication Standardization Sector of ITU ITU-T Recommendation G.722 7kHz Audio-Coding within 64 KBIT/S.

* cited by examiner

*Primary Examiner*—Brian D Nguyen
(74) *Attorney, Agent, or Firm*—Venable LLP; Michael A. Sartori; Kyle D. Petaja

(57) ABSTRACT

A receiving device exhibits a high communication quality even if having a small time complexity and a small space complexity. The receiving receives a transmission unit signal sent from a sending device via a predetermined transmission path and executes a reproduction output corresponding to an element periodic signal that is a decoding result of the plurality of encoded element periodic signals extracted from the transmission unit signal. The receiving device detects a predetermined interference event to interfere with using of the encoded element periodic signals packed in the transmission unit signal for the reproduction output and interpolates an alternative element periodic signal into a series of element periodic signals.

7 Claims, 3 Drawing Sheets

RECEIVING DEVICE AND METHOD

TECHNICAL FIELD

The present invention relates to a receiving device and method, and is suitably applied to the case of dividing a wide band of a voice signal into two bands to transmit the voice signal, for example.

BACKGROUND ART

At present, voice communication using a network such as the Internet has been actively conducted by the use of a VoIP technology.

In communication over a network such as the Internet, in which the communication quality is not assured, a packet loss that a packet is lost during transmission frequently causes a phenomenon (voice loss) that a part of voice data, which is supposed to be received in a time series under normal circumstances, is lost. When a voice loss occurs, if the voice data is decoded as it is, voice is frequently interrupted to degrade the voice quality. A technology disclosed in non-patent document 1 to be described below has been already known as a method for compensating this degradation.

In this method, the occurrence of a voice loss is monitored for each voice frame (packet) which is a decoding processing unit, and every time the voice loss occurs, compensation processing is performed. In this compensation processing, voice data after decoding a series of encoded voice data is stored in an internal memory or the like, and when a voice loss occurs, a fundamental period near a position where the voice loss occurs is obtained on the basis of voice data read from the internal memory. Then, the voice data is extracted from the internal memory to perform interpolation in regard to a frame in which voice data needs to be interpolated (compensated) because of the voice loss, so that the starting phase of the frame matches the ending phase of an immediately preceding frame to be able to secure continuity in a waveform period (fundamental period).

Meanwhile, technologies described in non-patent documents 2 and 3 to be described below are known as a method of voice communication over a network.

In the technology described in the non-patent document 2, voice data is transmitted in a single band, but the technology described in the non-patent document 3 relates to a band division method (SB-ADPCM) in which voice data of a wider band (for example, a band of 8 kHz) than usual is divided into two bands and is transmitted so as to realize voice communication of high quality.

Non-patent document 1: ITU-T Recommendation G. 711 Appendix I

Non-patent document 2: ITU-T Recommendation G. 711

Non-patent document 3: ITU-T Recommendation G. 722

DISCLOSURE OF THE INVENTION

Problem to be Solved by the Invention

Incidentally, if the band division method described in the non-patent document 3 is applied as it is to a reception processing device of voice data, it is necessary to provide the reception processing device with processing systems each of which performs the same processing independently for each band, which results in increasing the time complexity and the space complexity.

For example, if this processing system is constructed of a general-purpose DSP (digital signal processor), the amount of memory and the amount of processing become large, which inevitably causes an increase in power consumption, an increase in the scale of a device, and an increase in cost.

Furthermore, when there are simply provided two independent processing systems are simply provided, the above-mentioned fundamental period is redundantly calculated in both bands because of the voice loss to cause an unnecessary increase in the time complexity and the space complexity. Moreover, when the fundamental period cannot be obtained in any one of the bands because it has a large amount of noise, the communication quality in the processing system of the band is degraded because the above-mentioned interpolation cannot be performed.

After all, when the band division method described in the non-patent document 3 is applied as it is to a reception processing device of voice data, the reception processing device will have a construction that degrades the communication quality and reduces efficiency considering a large time complexity and a large space complexity.

Means for Solving the Problem

In order to solve the problems, according to the first embodiment, a receiving device which receives a transmission unit signal sent from a sending device via a predetermined transmission path, the transmission unit signal containing a plurality of encoded element periodic signals, and which executes a reproduction output corresponding to an element periodic signal that is a decoding result of the plurality of encoded element periodic signals extracted from the transmission unit signal, the plurality of encoded element periodic signals being obtained by dividing an original periodic signal produced from a predetermined source of production in accordance with respective logic channels; the receiving device includes: (1) an interference event detecting means for detecting that a predetermined interference event to interfere with using of the encoded element periodic signals packed in the transmission unit signal for the reproduction output occurs in any of the transmission unit signals received in a time series during transmission via the transmission path; and (2) interpolation means of the number of the logic channels, each of which produces an alternative element periodic signal on the basis of a predetermined period and interpolates the alternative element periodic signal into a series of element periodic signals when the interference event detecting means detects occurrence of the interference event, the alternative element periodic signal being to become alternative to the encoded element periodic signal packed in the transmission unit signal; (3) wherein each of the plurality of interpolation means provided for the respective logic channels includes an element periodic signal storing section for storing the element periodic signal of the decoding result of the encoded element periodic signal extracted from the transmission unit signal received by each corresponding logic channel; (4) wherein any one of the plurality of interpolation means provided for the respective logic channels includes:

a period calculating section for calculating a value of the period, which is information to become a base for producing the alternative element periodic signal and is common to the respective element periodic signals obtained by dividing the same original periodic signal, from the element periodic signal stored in the element periodic signal storing section; and (5) a period notifying section for giving a notice of the value of the calculated period to other interpolation means.

Further, according to the second invention, a receiving method for receives a transmission unit signal sent from a sending device via a predetermined transmission path, the transmission unit signal containing a plurality of encoded element periodic signals, and for executing a reproduction output corresponding to an element periodic signal that is a decoding result of the plurality of encoded element periodic signals extracted from the transmission unit signal, the plurality of encoded element periodic signals being obtained by dividing an original periodic signal produced from a predetermined source of production in accordance with respective logic channels; the receiving method includes the steps of: (1) detecting, by an interference event detecting means, that a predetermined interference event to interfere with using of the encoded element periodic signals packed in the transmission unit signal for the reproduction output occurs in any of the transmission unit signals received in a time series during transmission via the transmission path; and (2) producing an alternative element periodic signal on the basis of a predetermined period and interpolating the alternative element periodic signal into a series of element periodic signals when the interference event detecting means detects occurrence of the interference event, the alternative element periodic signal being to become alternative to the encoded element periodic signal packed in the transmission unit signal, by each of interpolation means of the number of the logic channels; (3) wherein each of the plurality of interpolation means provided for the respective logic channels causes an element periodic signal storing section to store the element periodic signal of the decoding result of the encoded element periodic signal extracted from the transmission unit signal received by each corresponding logic channel; (4) wherein any one of the plurality of interpolation means provided for the respective logic channels causes a period calculating section to calculate a value of the period, which is information to become a base for producing the alternative element periodic signal and is common to the respective element periodic signals obtained by dividing the same original periodic signal, from the element periodic signal stored in the element periodic signal storing section; and (5) causes a period notifying section to give a notice of the value of the calculated period to other interpolation means.

Effect of the Invention

According to the present invention, it is possible to realize a construction that can improve the communication quality and can enhance efficiency considering a small time complexity and a small space complexity.

DESCRIPTION OF THE REFERENCE SYMBOLS

11A, 11B decoder; 12 loss-determining device; 13A, 13B interpolator; 14 band combiner; 20 communication system; 21 network; 22, 23 communication terminal; 30, 40 control section; 31, 43 decoded waveform storing section; 32 waveform period calculating section; 33 period notifying section; 34, 42 interpolation executing section; 41 notice receiving section; PK11-PK13 packet; CD1, CD2, CD11-CD13, CD21-CD23 voice data; DC1, DC2, DC11-DC13, DC21-DC23 decoding result; PS fundamental period.

BEST MODE FOR CARRYING OUT THE INVENTION

(A) Embodiment

An embodiment will be described below by taking a case, in which a receiving device and a receiving method in accordance with the present invention are applied to voice communication using a VoIP.

(A-1) Construction of Embodiment

Figure 4:
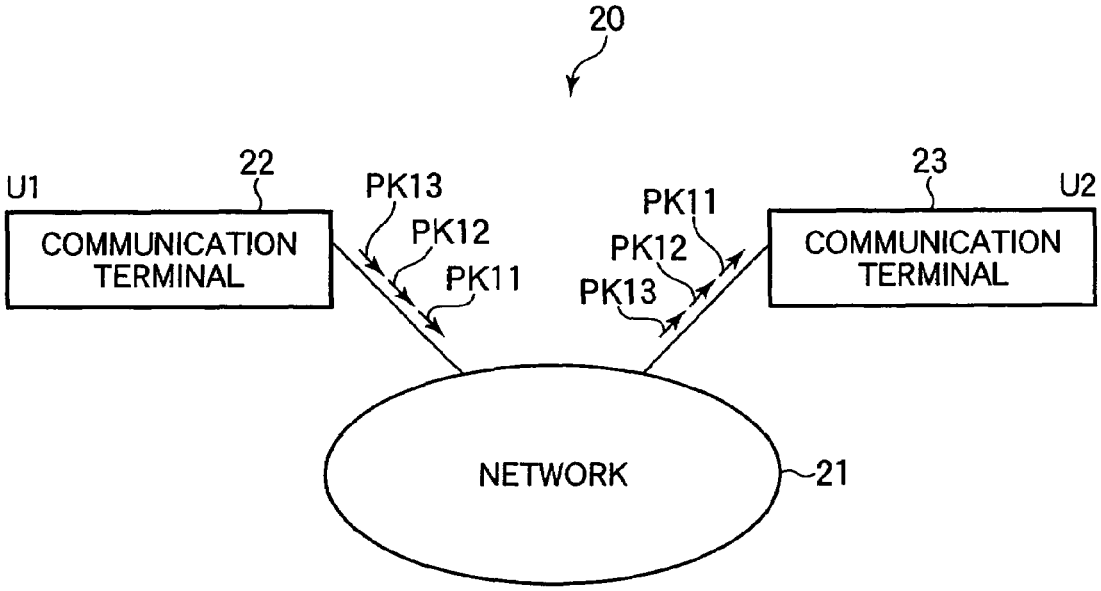
FIG. 4 is a schematic diagram showing a whole construction example of a communication system in accordance with the embodiment.

The whole construction example of a communication system 20 in accordance with the present embodiment is shown in FIG. 4.

Referring to FIG. 4, the communication system 20 includes a network 21 and communication terminals 22 and 23.

Among them, the network 21 may be the Internet and may be an IP network that is provided by a communications carrier and has the communication quality assured to some extent.

Moreover, the communication terminal 22 is a communication device, for example, an IP telephone capable of conducting a voice conversation in real time. The IP telephone uses a VoIP technology and makes it possible to conduct a telephone conversation by exchanging voice data on a network using an IP protocol. The communication terminal 23 is also the same communication device as the communication terminal 22.

The communication terminal 22 is used by a user U1, and the communication terminal 23 is used by a user U2. Commonly, voice is exchanged bidirectionally in the IP telephone so as to establish conversation between the users. Here, voice frames (voice packets) PK11 to PK13 are sent from the communication terminal 22 and description will be provided by paying attention to a direction in which these packets are received by the communication terminal 23 via the network 21.

These packets PK11 to PK13 include voice data indicating contents (voice information) uttered by the user U1. Hence, insofar as this direction is concerned, the communication terminal 23 performs only receiving processing and the user U2 only hears voice uttered by the user U1.

The order of sending (which corresponds to the order of reproduction output on a receiving side) is determined among the packets PK11 to PK13 of these packets. That is, the packets PK11 to PK13 are sent in the order of PK11, PK12, and PK13.

In the present embodiment, the band division method disclosed in the non-patent document 3 is employed and the respective bands obtained by dividing a wide band into two bands can be considered to be separate logic channels. For example, when voice information of a wide band having a bandwidth of 8 kHz is divided into two bands at a position of 4 kHz on a frequency axis, voice information can be obtained for two bands (narrow bands) of a narrow bandwidth of 4 kHz. In this case, for example, there are provided a narrow band WA located within a range from 0 to spread in the direction of frequency axis and hence there is a possibility that the same (or similar) waveform will exist in common in the voice information in the narrow band WA and in the voice information in the narrow band WB. For this reason, for example, a waveform corresponding to the fundamental period can also exist in common in both narrow bands WA and WB.

When the packets are sent in the order of PK11, PK12, PK13, . . . , in many cases, all of the packets are received by the communication terminal 23 in this order without a dropout. However, a packet loss may be caused by the event of congestion of a router (not shown) on the network 21. The packet lost by a packet loss may be, for example, PK12.

Figure 1:
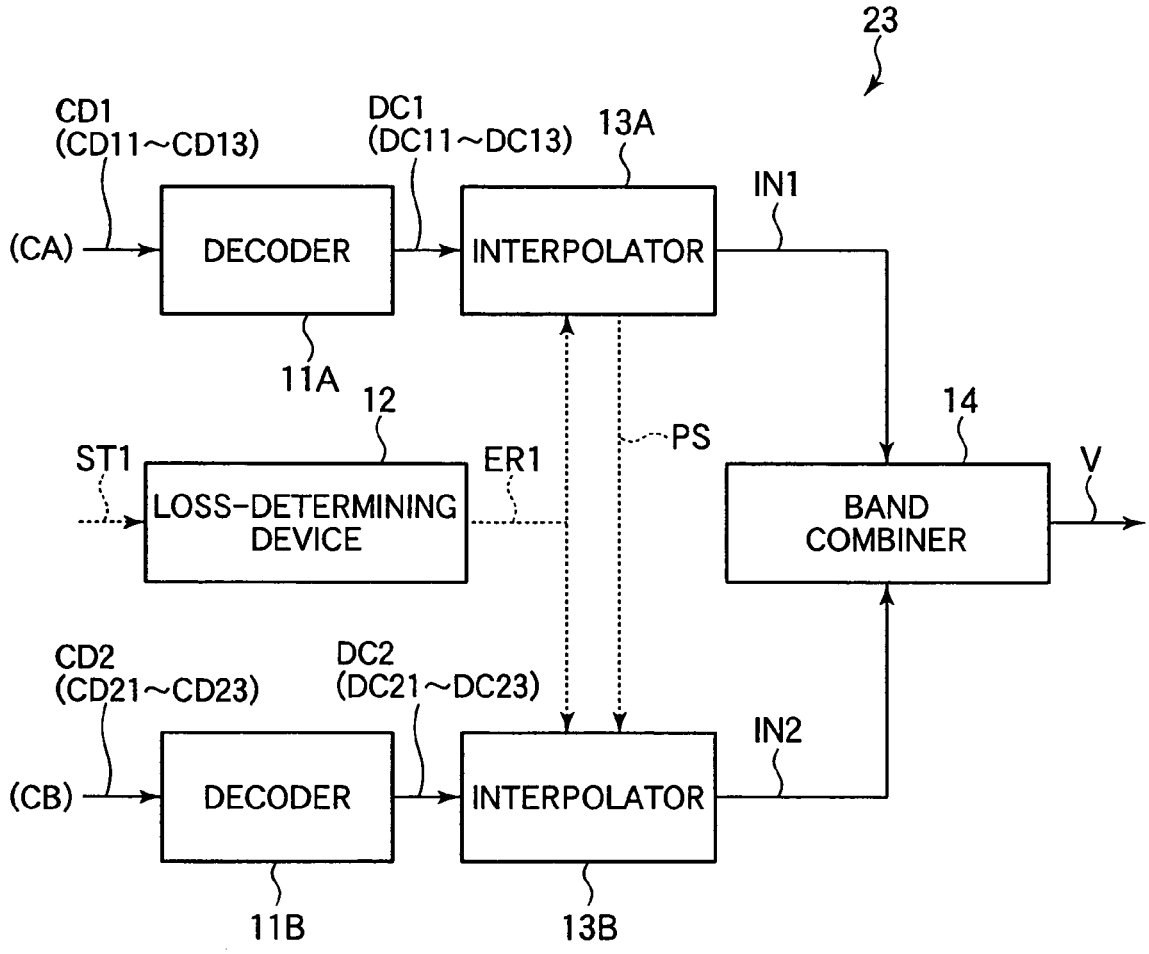
FIG. 1 is a schematic diagram showing a construction example of a main portion of a communication terminal used in the embodiment.

The present embodiment is characterized in the function of a receiving side and hence description will be provided hereinafter by paying attention to the communication terminal 23. The construction example of a main portion of the communication terminal 23 is shown in FIG. 1. Naturally, the communication terminal 22 may be provided with the same construction as this so as to perform receiving processing.

(A-1-1) Construction Example of Communication Terminal

Referring to FIG. 1, the communication terminal 23 includes decoders 11A and 11B, a loss-determining device 12, interpolators 13A and 13B, and a band combiner 14.

Among them, the decoder 11A is a decoder for the above-mentioned logic channel CA and is a part that decodes voice data CD1 extracted from each packet (for example, PK11, etc.) received by the communication terminal 23 and outputs a decoding result DC1. Here, CD1 is a symbol used for collectively calling respective voice data CD11 to CD13 corresponding to the logic channel CA. Also in the following description, when it is not necessary to discriminate CD11 to CD13 from each other, this CD1 is used.

The number of samples included in one voice data (for example, CD11) can be arbitrarily determined and may be approximately 160 samples as one example.

The decoding result of the voice data CD11 by the decoder 11A is DC11, the decoding result of the voice data CD12 is DC12, and the decoding result of the voice data CD13 is DC13. As to the decoding result, when it is not necessary to discriminate DC11 to DC13 from each other, a symbol DC1 is used to call the decoding result collectively.

The decoder 11B is entirely the same in its function as the decoder 11A. However, this decoder 11B is a decoder for the logic channel CB, decodes voice data CD21 to CD23, and outputs DC21 to DC23 as decoding results. A symbol CD2 relating to the input/output of the decoder 11B corresponds to the CD1 and a symbol DC2 corresponds to the DC1.

The loss-determining device 12 is a part that detects the occurrence of the packet loss (voice loss) on the basis of basic information ST1 and outputs a state-of-loss detection result ER1. When a packet loss occurs, interpolation by the interpolators 13A and 13B is necessary and hence the loss-determining device 12 provides a notice to this effect according to the state-of-loss detection result ER1 to the interpolators 13A and 13B.

Various methods can be used as a method for detecting a packet loss. For example, when a dropout occurs in a sequence number (a serial number that the communication terminal 22 assigns at the time of sending a packet) that is held by a RTP header and the like packed in each packet and is supposed to be a serial number, it is advisable to determine that a packet loss occurs. When a packet is delayed to an excessively large amount in terms of the value of a time stamp (information of a sending time that the communication terminal 22 assigns at the time of sending the packet) held by the RTP header, it is also advisable to determine that a packet loss occurs. In the case of using a sequence number, the basic information ST1 becomes the sequence number and in the case of using a time stamp, the basic information ST1 becomes the time stamp.

There is a possibility that a packet once determined to be lost by a packet loss will be received later but, in this case, the received packet may be discarded. This is because voice data that is not received before timing to be received cannot be used for outputting voice in real-time communication.

However, in the case of determining a packet loss on the basis of a sequence number, when a packet is received at the timing when there is still time to output voice, there is a possibility that the received packet can be used for outputting voice by exchanging the order of the received packet in the communication terminal 23. Hence, in the case of exchanging the order of the received packet in this manner, it is advisable to make consideration not to make the timing of providing a notice of a packet loss according to the state-of-loss detection result ER1 too early.

The interpolator 13A is a part that interpolates interpolation voice (interpolation voice information) into a series of decoding result DC1 outputted from the decoder 11A and outputs an interpolation result IN1. That is, when the state-of-loss detection result ER1 indicates a voice loss, the interpolator 13A interpolates interpolation voice produced on the basis of the value of the fundamental period (referred to as "PS") into a time period corresponding to the voice loss to perform interpolation, and when the state-of-loss detection result ER1 does not indicate a voice loss, the interpolator 13A transparently passes the received decoding result DC1 without executing interpolation. The output of the interpolator 13A is made the interpolation result IN1 irrespective of whether or not the interpolator 13A performs interpolation.

Moreover, to produce the interpolation voice, the interpolator 13A always stores the newest decoding result (for example, DC11). Although there is a possibility that various methods can be used also for executing interpolation, it is assumed here that the method disclosed in the non-patent document 1 is used. When interpolation is performed by the method disclosed in the above-mentioned non-patent document 1, the fundamental period PS is an essential parameter.

As far as the function having been hitherto described is concerned, the interpolator 13B is the same as the interpolator 13A, but there is an important difference in function between them.

That is, the interpolator 13A has the function of producing a fundamental period PS on the basis of the stored newest decoding result (for example, DC11) and of giving a notice of the fundamental period PS to the other interpolator 13B. However, the interpolator 13B has only the function of producing interpolation voice on the basis of the received fundamental period PS and of executing the above-mentioned interpolation.

It is also possible to employ a construction that every time the interpolator 13A receives a new decoding result (for example, DC11), the interpolator 13A produces a fundamental period PS and gives a notice of the fundamental period PS to the other interpolator 13B. To reduce load applied to the processing capacity of the communication terminal 23 and to decrease the complexity, however, it is effective to employ a construction that when the loss-determining device 12 indicates the occurrence of a voice loss by the state-of-loss result ER1, the interpolator 13A calculates a fundamental period PS.

In the case of the present embodiment, the voice data (for example, CD11 and CD21) of the logic channels CA and CB are packed in the same packet (for example, PK11) and hence when interpolation is necessary on the interpolation 13A side, interpolation is necessary also on the interpolation 13B side. Hence, the fundamental period PS calculated by the interpolator 13A is used for producing interpolation voice by itself and is used also for producing interpolation voice by the interpolator 13B. However, when the interpolator 13B uses the fundamental period PS, the interpolator 13B needs to be given such a notice of the fundamental period PS that will be described later.

The interpolator 13B may or may not receive the state-of-loss detection result ER1. In either of cases, when the interpolator 13B is given a notice of the fundamental period PS from the interpolator 13A, the interpolator 13B produces interpolation voice by the use of this fundamental period PS and performs interpolation to a series of decoding result DC2.

Figure 2:
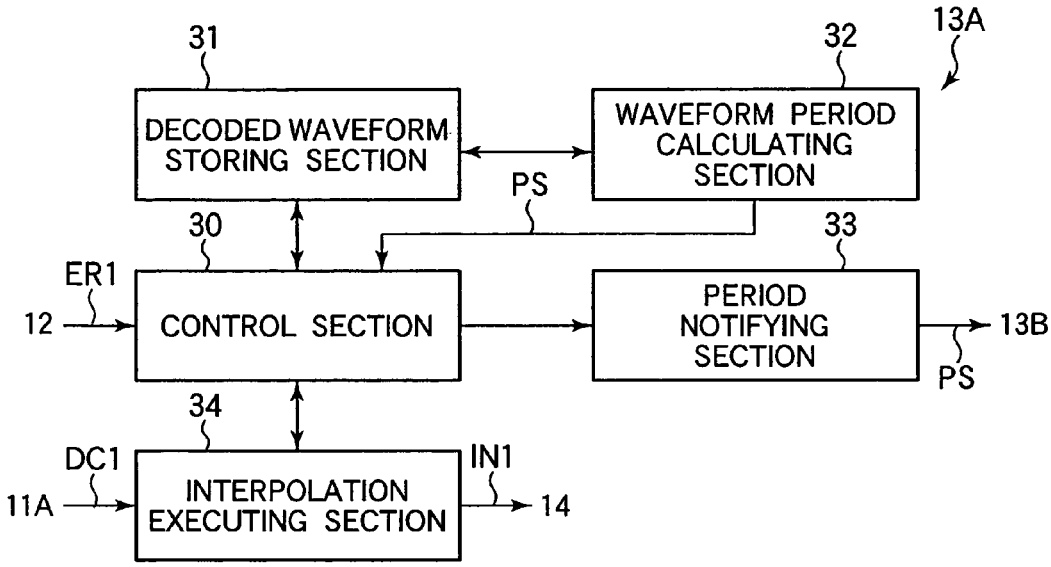
FIG. 2 is a schematic diagram showing a construction example of an interpolator included in the communication terminal of the embodiment.

As shown in FIG. 2, the interpolator 13A includes a control section 30, a decoded waveform storing section 31, a waveform period calculating section 32, a period notifying section 33, and an interpolation executing section 34.

Among them, the control section 30 is a part that controls the respective constituent sections 31 to 34 in the interpolator 13A.

The interpolation executing section 34 is a part that performs interpolation if necessary to a series of decoding result DC1 received from the decoder 11A and outputs an interpolation result IN1 to the band combiner 14. This interpolation result IN1 is nearly identical with the series of decoding result DC1, but when interpolation is performed, the interpolation result IN1 is different from the series of decoding result DC1 in that interpolation voice is interpolated into a corresponding time period (time period during which a voice loss occurs).

At least the newest result of the decoding result DC1 that the interpolation executing section 34 receives in a time series from the decoder 11A is stored in the decoded waveform storing section 31. The amount of decoding result DC1 stored in the decoded waveform storing section 31 is only an amount necessary for producing interpolation voice.

As to the management of a storage area in the decoded waveform storing section 31, it is also advisable that every time a new decoding result (for example, DC12) is supplied, storage data of the same size is deleted (or invalidated) in the order of storage from oldest (for example, DC11) to newest to secure a storage area for storing its new decoding result.

The waveform calculating section 32 is a part that produces a fundamental period PS on the basis of the newest decoding result (for example, DC12) stored in the decoded waveform storing section 31, when necessary. There is a possibility that various methods can be used for this calculation and, for example, it is also advisable to employ a method of calculating a publicly known autocorrelation coefficient by the use of the newest decoding result DC12 and of setting the amount of delay to maximize a calculation result for a fundamental period PS. The calculated fundamental period PS is used for interpolation performed in the interpolator 13A and also for interpolation performed in the other interpolator 13B, as already described above.

For the other interpolator 13B to perform interpolation, it is necessary to give a notice of the fundamental period PS to the other interpolator 13B by the use of the period notifying section 33. When the interpolator 13A uses the fundamental period PS to perform interpolation, however, the fundamental period PS is passed to the interpolation executing section 34 via the control section 30. When the interpolation voice is produced, the fundamental period PS is used for determining which decoded waveform of the decoded waveforms stored in the decoded waveform storing section 43 is used for interpolation voice.

Figure 3:
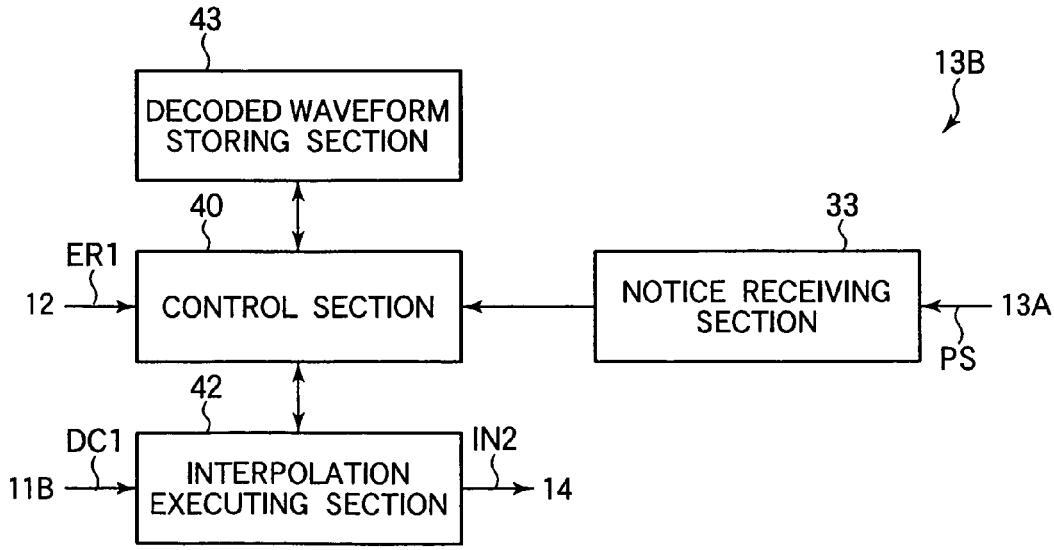
FIG. 3 is a schematic diagram showing a construction example of another interpolator included in the communication terminal of the embodiment.

Meanwhile, the interpolator 13B, as shown in FIG. 3, includes a control section 40, a notice receiving section 41, an interpolation executing section 42, and a decoded waveform storing section 43.

Among them, the control section 40 corresponds to the control section 30, the interpolation executing section 42 corresponds to the interpolation executing section 34, and the decoded waveform storing section 43 corresponds to the decoded waveform storing section 31. Hence, they are not described in detail here.

The notice receiving section 41 is a part opposite to the period notifying section 33, receives a notice of the fundamental period PS given by the period notifying section 33, and passes it to the control section 40. The interpolation executing section 42 that receives the fundamental period PS via the control section 40 produces interpolation voice on the basis of the fundamental period PS.

As is clear by a comparison of FIG. 2 and FIG. 3, a constituent part corresponding to the waveform period calculating section 32 is not in the interpolator 13B. Hence, it is possible to reduce the space complexity in that a storage area for operation is hardly necessary and to decrease the time complexity in that a necessary processing capacity is little.

An interpolation result IN1 outputted from the interpolator 13A and an interpolation result IN2 outputted from the interpolator 13B are supplied to the band combiner 14 shown in FIG. 1. The band combiner 14 couples these interpolation results IN1 and IN2 to restore them to voice V of the same wide band as voice just after collecting voice uttered by the user U1 on the communication terminal 22 side and outputs the restored voice V.

In this regard, when a set of respective decoding results (for example, a set of DC11 and DC21) corresponding to the above-described set of same voice data (for example, CD11 and CD21) that are supposed to be processed at the same time can not be obtained at the same time in a strict sense, it is also desirable to employ a construction such that the respective decoding results are temporarily stored, for example, in a memory and are delayed to adjust timing, whereby the respective decoding results belonging to the same set are supplied to the interpolators 13A and 13B at the same time. This adjustment of timing is effective also in the case where the sizes of voice data (for example, CD11 and CD21) constructing the same set are different from each other.

The operation of the present embodiment having the above-mentioned construction will be described below.

(A-2) Operation of Embodiment

When the band division method disclosed in the non-patent document 3 is used, voice uttered by the user U1 is divided into narrow bands WA and WB. Hence, voice information corresponding to the respective narrow bands WA and WB is decoded to make different voice data (for example, CD11 and CD21) and is packed in the same packet (for example, PK11) and is sent from the communication terminal 22.

The order of sending of the respective packets from the communication terminal 22, as described above, is the order of PK11, PK12, PK13, . . . .

If a packet loss does not occur when the packets PK11 to PK13 are transmitted via the network 21, the state-of-loss detection result ER1 outputted by the loss-determining device 14, shown in FIG. 1, in the communication terminal 23 does not indicate the occurrence of a voice loss. Hence, the interpolators 13A and 13B passes the decoding results DC1 and DC2 received from the decoder 11A and 11B transparently without interpolating interpolation voice (as interpolation results IN1 and IN2) to the band combiner 14.

If this state continues and there is not other cause to degrade the communication quality (the occurrence of large jitters or the like), the communication terminal 73 can continue a voice output at a high level of voice quality.

However, when any one of the packets (here, assumed to be PK12) is lost by a packet loss, the above-mentioned state-of-loss detection result ER1 indicates the occurrence of a voice loss and hence the interpolator 13A causes the waveform period calculating section 32 to calculate a fundamental period PS on the basis of the decoding result (here, DC11 (if necessary, including also decoding results before DC11)) already stored in the decoded waveform storing section 31. Here, the calculated fundamental period PS corresponds to the fundamental period of a waveform just before the voice loss.

This fundamental period PS is not only used for the interpolator 13A but also given to the interpolator 13B.

The interpolator 13A determines which waveform of the decoded waveforms stored in the decoded waveform storing section 31 is used on the basis of the fundamental period PS and produces interpolation voice on the basis of the decoded waveform and interpolates the interpolation voice into the series of decoding result DC1 to thereby perform interpolation.

The interpolation voice is interpolated into a position where DC12 of the decoding result of the voice data CD12, which is supposed to be packed in the PK12 if the packet loss of the packet PK12 does not occur, exists in the series of decoding result DC1, that is, a position between the DC11 and DC13 of the decoding result.

Also in the interpolator 13B that receives the fundamental period. PS from the interpolator 13A, the same interpolation as in the interpolator 13A is performed. That is, the interpolator 13B determine which time of the decoded waveform stored in the decoded waveform storing section 43 is used on the basis of the fundamental period PS and produces interpolation voice on the basis of the decoded waveform and interpolates the interpolation voice into a position where the decoding result DC22 is supposed to exist in the series of decoding result DC2.

The series of decoding result IN2 including the interpolation voice is supplied from the interpolator 13B to the band combiner 14, is coupled with the series of interpolation result IN1 supplied from the interpolator 13A to the band combiner 14, and is outputted as voice V of a wide band. The user U2 on the communication terminal 23 side hears this voice V.

In this case, the user U2 hears the coupled interpolation voice at the time when voice V corresponding to a set of DC12 and DC22 of the decoding results is supposed to be outputted.

Because the interpolation voice is pseudo voice information, as compared with a case where DC12 and DC22 of original decoding results are obtained, it is inevitable that the quality of voice V heard by the user U2 is degraded. However, as compared with a case where even though a voice loss occurs, even the interpolation of interpolation voice cannot be performed, it can be said that the quality of voice V can be improved.

In addition, in the present embodiment, the waveform period calculating section 32 that is a constituent section for making a fundamental period PS necessary for producing interpolation voice needs to be provided only on the interpolator 13A side of two interpolators 13A and 13B. Hence, considering the high voice quality, the time complexity and the space complexity are small and also the size of a device is small.

(A-3) Effect of Embodiment

According to the present embodiment, because the fundamental period (PS) is calculated only on the one logic channel (CA) side, the time complexity and the space complexity necessary for the calculation can be reduced. Therefore, it is possible to provide the communication terminal (23) having a construction capable of increasing the communication quality and enhancing efficiency considering a small time complexity and a small space complexity.

A small time complexity and a small space complexity result in reducing or decreasing the amount of memory, the amount of processing of operation, the size of a device, and power consumption in a specific package and hence can prevent an increase in cost.

(B) Other Embodiments

In spite of the above-mentioned embodiment, the construction in FIG. 2 may be used for the interpolator 13B for processing the logic channel CB corresponding to the narrow band WB of a higher frequency and the construction in FIG. 3 may be used for the interpolator 13A for processing the logic channel CA corresponding to the narrow band WA of a lower frequency.

In the above-mentioned embodiment, the narrow bands WA and WB are in contact with each other on a frequency axis. However, two narrow bands that are not in contact with each other (for example, a narrow band of 0 to 4 kHz and a narrow band of 4.5 to 8 kHz) can be set.

Naturally, the number of set narrow bands may be three or more. When the number of narrow bands is three or more, the number of interpolators included in one communication terminal is also three or more.

Moreover, it is also effective to employ a construction that a plurality of interpolators having the constituent sections 31, 32, and 33 shown in FIG. 2 exist in one communication terminal.

In reality, there is a possibility that a lot of noise will develop only in any one of divided bands (any one of logic cannels) to make it impossible to obtain a fundamental period. In this case, it is effective that one communication terminal is provided with a plurality of interpolators having the construction shown in FIG. 2. In this case, however, a construction such that each interpolator includes also a constituent section corresponding to the notice receiving section 41 in FIG. 3 in addition to the construction in FIG. 2 and gives a notice of the value of a fundamental period to the other interpolators.

This is because if there is provided a construction such that the plurality of interpolators corresponding to the plurality of logic channels can calculate the value of a fundamental period and can give a notice of the value to the other interpolators, when any one of the logic channels has a small amount of noise, the other interpolators can use the value of a fundamental period calculated by the interpolator corresponding to that logic channel and hence can perform effective interpolation. This can decrease the probability of developing a state where effective interpolation cannot be performed in all of the logic channels and hence can further improve the communication quality.

Moreover, as described above, it is also advisable to pack the voice information of the respective logic channels (for example, CA and CB) in separate packets to send it.

In the above-mentioned embodiments, voice information divided on the frequency axis is transmitted by different logic channels. However, the voice information transmitted by different logic channels is not necessarily such that is divided on the frequency axis. For example, voice information divided on a time axis can be transmitted by the different logic channels. Even if the voice information is divided on the time axis, if the unit of division is sufficiently short time, it is possible to conduct communication of a real time property.

In the above-mentioned embodiments, when the packet loss (voice loss) occurs, interpolation is performed by the interpolator but even when the packet loss does not occur, there is a possibility that interpolation can be performed.

For example, when the occurrence of an error in transmission or the mixture of noises is detected in a certain packet (frame), interpolation may be performed. This is because when a packet can be received but an error in transmission or noise is detected, voice data in that packet might be destroyed or degraded in quality and hence it might be better to replace the voice data with interpolation voice.

While the present invention has been described by taking voice information by the telephone (IP telephone) as the example in the above-mentioned embodiments, the present invention can be applied to voice information other than the voice information by the telephone. For example, the present invention can be widely applied to a case where processing using periodicity such as voice and tone signal is performed in parallel.

Further, the range of applications of the present invention is not necessarily limited to the voice and the tone signal, but there is a possibility that the present invention can be applied to image information such as moving image.

Still further, naturally, it is not necessary to limit a communication protocol, to which the present invention is applied, to the above-mentioned IP protocol.

While the present invention is realized mainly by means of hardware in the above description, the present invention can be also realized by means of software.

The invention claimed is:

1. A receiving device which receives a transmission unit signal sent from a sending device via a predetermined transmission path, the transmission unit signal containing a plurality of encoded element periodic signals, and which executes a reproduction output corresponding to an element periodic signal that is a decoding result of the plurality of encoded element periodic signals extracted from the transmission unit signal, the plurality of encoded element periodic signals being obtained by dividing an original periodic signal produced from a predetermined source of production in accordance with respective logic channels;

the receiving device comprising:

an interference event detecting means for detecting that a predetermined interference event to interfere with using of the encoded element periodic signals packed in the transmission unit signal for the reproduction output occurs in any of the transmission unit signals received in a time series during transmission via the transmission path; and interpolation means of the number of the logic channels, each of which produces an alternative element periodic signal and interpolates the alternative element periodic signal into a series of element periodic signals when the interference event detecting means detects occurrence of the interference event, the alternative element periodic signal being to become alternative to the encoded element periodic signal packed in the transmission unit signal;

wherein each of the interpolation means provided for the respective logic channels includes an element periodic signal storing section for storing the element periodic signal of the decoding result of the encoded element periodic signal extracted from the transmission unit signal received by each corresponding logic channel;

wherein any one of the interpolation means provided for the respective logic channels includes:

a period calculating section for calculating a value of a period, which is information to become a base for producing the alternative element periodic signal and is common to the respective element periodic signals obtained by dividing the same original periodic signal, from the element periodic signal stored in the element periodic signal storing section; and a period notifying section for giving a notice of the value of the calculated period to other interpolation means.

2. The receiving device according to claim 1, wherein each of at least two of the interpolation means provided for the respective logic channels includes the element periodic signal storing section, the period calculating section, and the period notifying section.

3. A receiving method for receives a transmission unit signal sent from a sending device via a predetermined transmission path, the transmission unit signal containing a plurality of encoded element periodic signals, and for executing a reproduction output corresponding to an element periodic signal that is a decoding result of the plurality of encoded element periodic signals extracted from the transmission unit signal, the plurality of encoded element periodic signals being obtained by dividing an original periodic signal produced from a predetermined source of production in accordance with respective logic channels;

the receiving method comprising the steps of:

detecting, by an interference event detecting means, that a predetermined interference event to interfere with using of the encoded element periodic signals packed in the transmission unit signal for the reproduction output occurs in any of the transmission unit signals received in a time series during transmission via the transmission path; and producing an alternative element periodic signal on the basis of a period and interpolating the alternative element periodic signal into a series of element periodic signals when the interference event detecting means detects occurrence of the interference event, the alternative element periodic signal being to become alternative to the encoded element periodic signal packed in the transmission unit signal, by each of interpolation means of the number of the logic channels;

wherein each of the interpolation means provided for the respective logic channels causes an element periodic signal storing section to store the element periodic signal of the decoding result of the encoded element periodic signal extracted from the transmission unit signal received by each corresponding logic channel;

wherein any one of the interpolation means provided for the respective logic channels causes a period calculating section to calculate a value of a period, which is information to become a base for producing the alternative element periodic signal and is common to the respective element periodic signals obtained by dividing the same original periodic signal, from the element periodic signal stored in the element periodic signal storing section; and causes a period notifying section to give a notice of the value of the calculated period to other interpolation means.

4. A receiving device which receives a transmission unit signal sent from a sending device via a predetermined transmission path, the transmission unit signal containing a plurality of encoded element voice data signals, and which executes a reproduction output corresponding to an element voice data signal that is a decoding result of the plurality of encoded element voice data signals extracted from the transmission unit signal, the plurality of encoded element voice data signals being obtained by dividing an original voice data signal produced from a predetermined source of production in accordance with respective logic channels;

the receiving device comprising:

an interference event detecting means for detecting that a predetermined interference event to interfere with using of the encoded element voice data signals packed in the transmission unit signal for the reproduction output occurs in any of the transmission unit signals received in a time series during transmission via the transmission path; and interpolation means of the number of the logic channels, each of which produces an alternative element voice data signal and interpolates the alternative element voice data signal into a series of element voice data signals when the interference event detecting means detects occurrence of the interference event, the alternative element voice data signal being to become alternative to the encoded element voice data signal packed in the transmission unit signal;

wherein each of the interpolation means provided for the respective logic channels includes an element voice data signal storing section for storing the element voice data signal of the decoding result of the encoded element voice data signal extracted from the transmission unit signal received by each corresponding logic channel;

wherein any one of the interpolation means provided for the respective logic channels includes:

a calculating section for calculating a value of a parameter, which is information to become a base for producing the alternative element voice data signal and is common to the respective element voice data signals obtained by dividing the same original voice data signal, from the element voice data signal stored in the element voice data signal storing section; and a notifying section for giving a notice of the value of the calculated parameter to other interpolation means.

5. The receiving device according to claim 4, wherein the voice data signal is a periodic signal having a periodicity that can be detected, the value of the parameter is a value of a period, which is common to the respective voice data signals obtained by dividing the same original voice data signal, and the interpolation means produces the voice data signal on the basis of a period calculated by the calculating section.

6. The receiving device according to claim 4, wherein each of at least two of the interpolation means provided for the respective logic channels includes the element voice data signal storing section, the calculating section, and the notifying section.

7. A receiving method for receives a transmission unit signal sent from a sending device via a predetermined transmission path, the transmission unit signal containing a plurality of encoded element voice data signals, and for executing a reproduction output corresponding to an element voice data signal that is a decoding result of the plurality of encoded element voice data signals extracted from the transmission unit signal, the plurality of encoded element voice data signals being obtained by dividing an original voice data signal produced from a predetermined source of production in accordance with respective logic channels;

the receiving method comprising the steps of:

detecting, by an interference event detecting means, that a predetermined interference event to interfere with using of the encoded element voice data signals packed in the transmission unit signal for the reproduction output occurs in any of the transmission unit signals received in a time series during transmission via the transmission path; and producing an alternative element voice data signal on the basis of a period and interpolating the alternative element voice data signal into a series of element voice data signals when the interference event detecting means detects occurrence of the interference event, the alternative element voice data signal being to become alternative to the encoded element voice data signal packed in the transmission unit signal, by each of interpolation means of the number of the logic channels;

wherein each of the interpolation means provided for the respective logic channels causes an element voice data signal storing section to store the element voice data signal of the decoding result of the encoded element voice data signal extracted from the transmission unit signal received by each corresponding logic channel;

wherein any one of the interpolation means provided for the respective logic channels causes a calculating section to calculate a value of a parameter, which is information to become a base for producing the alternative element voice data signal and is common to the respective element voice data signals obtained by dividing the same original voice data signal, from the element voice data signal stored in the element voice data signal storing section; and causes a notifying section to give a notice of the value of the calculated parameter to other interpolation means.

* * * * *

UNITED STATES PATENT AND TRADEMARK OFFICE

CERTIFICATE OF CORRECTION

PATENT NO. : 7,586,937 B2
APPLICATION NO. : 10/577440
DATED : September 8, 2009
INVENTOR(S) : Atsushi Tashiro It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 749 days.

Signed and Sealed this

Twenty-first Day of September, 2010

David J. Kappos

David J. Kappos
*Director of the United States Patent and Trademark Office*